United States Patent [19]

Sano

[11] 4,172,973

[45] Oct. 30, 1979

[54] SEESAW SWITCH WITH LIGHT EMITTING DIODE ELEMENT

[75] Inventor: Minoru Sano, Yokosuka, Japan

[73] Assignee: Fujisoku Electric Co., Ltd., Kawasaki, Japan

[21] Appl. No.: 926,020

[22] Filed: Jul. 19, 1978

[30] Foreign Application Priority Data

| | | | |
|---|---|---|---|
| Jul. 20, 1977 | [JP] | Japan | 52/96639[U] |
| Dec. 3, 1977 | [JP] | Japan | 52/162283[U] |
| Dec. 3, 1977 | [JP] | Japan | 52/162285[U] |

[51] Int. Cl.[2] ..... H01H 9/00; H01H 3/00

[52] U.S. Cl. ..... 200/315; 200/339

[58] Field of Search ..... 200/315, 309, 339

[56] References Cited

U.S. PATENT DOCUMENTS

| | | | |
|---|---|---|---|
| 3,225,156 | 12/1965 | Sahrbacker | 200/339 X |
| 3,294,945 | 12/1966 | McLaughlin | 200/315 |
| 3,435,169 | 3/1969 | Bienwald et al. | 200/315 |
| 3,651,296 | 3/1972 | Yarbrough | 200/315 |
| 3,735,077 | 5/1973 | Ohashi | 200/315 |
| 3,743,805 | 7/1973 | Guinan | 200/315 |
| 4,013,857 | 3/1977 | Tanaka | 200/315 |
| 4,115,673 | 9/1978 | Smith | 200/315 |

FOREIGN PATENT DOCUMENTS

| | | |
|---|---|---|
| 51-1492 | 12/1969 | Japan. |
| 52-37799 | 4/1974 | Japan. |
| 51-8476 | 7/1974 | Japan. |

*Primary Examiner*—Steven M. Pollard

*Attorney, Agent, or Firm*—Flynn & Frishauf

[57] ABSTRACT

Disclosed is a seesaw switch with a light emitting diode element in which a light emitting portion of the light emitting diode element is disposed on the surface of a seesaw button. The base of the light emitting diode element is attached to a holder, lead wires of the element extending along the outer surface of the holder. The holder is received by a receiving portion of a rockable member, which is rockably borne on a case. The rockable member is fitted with a spring-biased rod, which, accompanying the rocking of the rockable member, slides on a movable contact laid on two switching terminals and a common terminal fixed to the bottom portion of the case for seesaw motion. Also fixed to the bottom portion of the case are two terminals for supplying electric power to the light emitting diode element. A spring of electrically conductive metal is inserted in each of these terminals, one end of the spring pressing on each corresponding lead wire on the outer surface of the holder and the other end pressing on each corresponding terminal.

11 Claims, 10 Drawing Figures

SEESAW SWITCH WITH LIGHT EMITTING DIODE ELEMENT

BACKGROUND OF THE INVENTION

This invention relates to a seesaw switch with an LED (light emitting diode) element, and more specifically to a seesaw switch with a light emitting portion of the LED element exposed from the surface of a seesaw button.

Seesaw switches with a light source have already been proposed and known in the art. These seesaw switches may be classified into two types according to the type of light source; one with a miniature incandescent lamp and the other with a light emitting diode element. Since the smallest possible incandescent lamp would be substantially bulkier than any light emitting diode element, the seesaw switch with an incandescent lamp as the light source should become large-sized as a whole. Although capable of providing a higher level of illumination, the incandescent lamp consumes a larger amount of electric power as compared with the LED element. It is prefarable that a light source provided for a seesaw switch has a long life time and a low power consumption as well as emits no heat. Accordingly, the light emitting diode element is preferred to the miniature incandescent lamp as the light source for a seesaw switch.

Seesaw switches with a light source may be classified also according to the position in which the light source is set. That is, some light sources are fixed to a case of the seesaw switch, whereas others are attached to a seesaw bottom of the switch. The seesaw switch of the former type may be simple in construction, only requiring a light transmitting portion in its seesaw button, though it is obliged to have a bulky case due to the incandescent lamp. Although the light emitting diode element may also be used with the switch of the former type, it cannot clearly indicate the button position because it should be located separated from the seesaw button so as to decrease its brightness. Therefore, the incandescent lamp is usually employed for the light source of a switch of such type. On the other hand, the seesaw switch of the latter type usually includes a light emitting diode element as its light source, so that it hardly varies from the one with no light source in size. Moreover, the light emitting portion of the light emitting diode element is exposed from the surface of the seesaw button, so the position of the seesaw button and circuit condition may be clearly indicated. In the seesaw switch of this type, however, the light emitting diode element is forced to move along with a rockable seesaw button, and must be securely electrically connected with terminals fixed to the case, leading to complicated construction of the switch which results in a switch which is unfit for mass production.

SUMMARY OF THE INVENTION

An object of this invention is to provide a compact seesaw switch having a seesaw button fitted with an LED element, suitable for mass production.

Another object of the invention is to provide a seesaw switch easy to manufacture and assemble in which a pair of lead wires attached to a rockable seesaw button are securely electrically connected with a pair of terminals fixed to a case.

Still another object of the invention is to provide a compact seesaw switch having a seesaw button fitted with two LED elements, suitable for mass production.

According to this invention, there is provided a seesaw switch comprising a light emitting diode element including at least two lead wires for power supply, a base to which the lead wires are fixed, and a light emitting portion disposed on the base; a holder for holding the base of the light emitting diode, and arranging the lead wires extending from the base along the outer surface of the holder with the lead wires being separated from one another; a rockable member including a holder receiving portion to receive the holder and a hole through which the lead wires arranged along the outer surface of the holder are exposed; a case for rockably supporting the rockable member with the holder receiving portion of the rockable member disposed outside the opening of the case; a seesaw button on the holder receiving portion of the rockable member and having a hole in which the light emitting portion of the light emitting diode element is received, the light emitting portion being exposed to the outside of the switch through the hole; a common terminal and two switching terminals of electrically conductive metal are fixed to the case and extend from the inside to the outside of the case; a movable contact of electrically conductive metal is at the ends of the terminals inside the case, always in contact with the common terminal, and in selective contact with either of the two switching terminals. The switch further comprises a spring-biased rod having one end supported by the rockable member and the other end being spring-bisased to bear against the movable contact, the other end of the rod sliding on the movable contact accompanying the turning motion of the rockable member, whereby the movable contact is switched from contact with one switching terminal to contact with the other; at least two power supply terminals of electrically conductive metal for supplying electric power to the light emitting diode element, fixed to the case and extending from the inside to the outside of the case; at least two springs of electrically conductive metal disposed in the hole of the rockable member at a distance or distances from one another, pressed against and interposed between the two power supply terminals and two lead wires arranged along the outer surface of the holder, by means of the biasing force of the springs, and expanding and contracting with the rocking of the rockable member, and a spring holding means for continually keeping in place the springs when they are distorted by said expansion and contraction thereof.

DETAILED DESCRIPTION OF THE PREFERRED EMBODIMENTS

Figure 1:
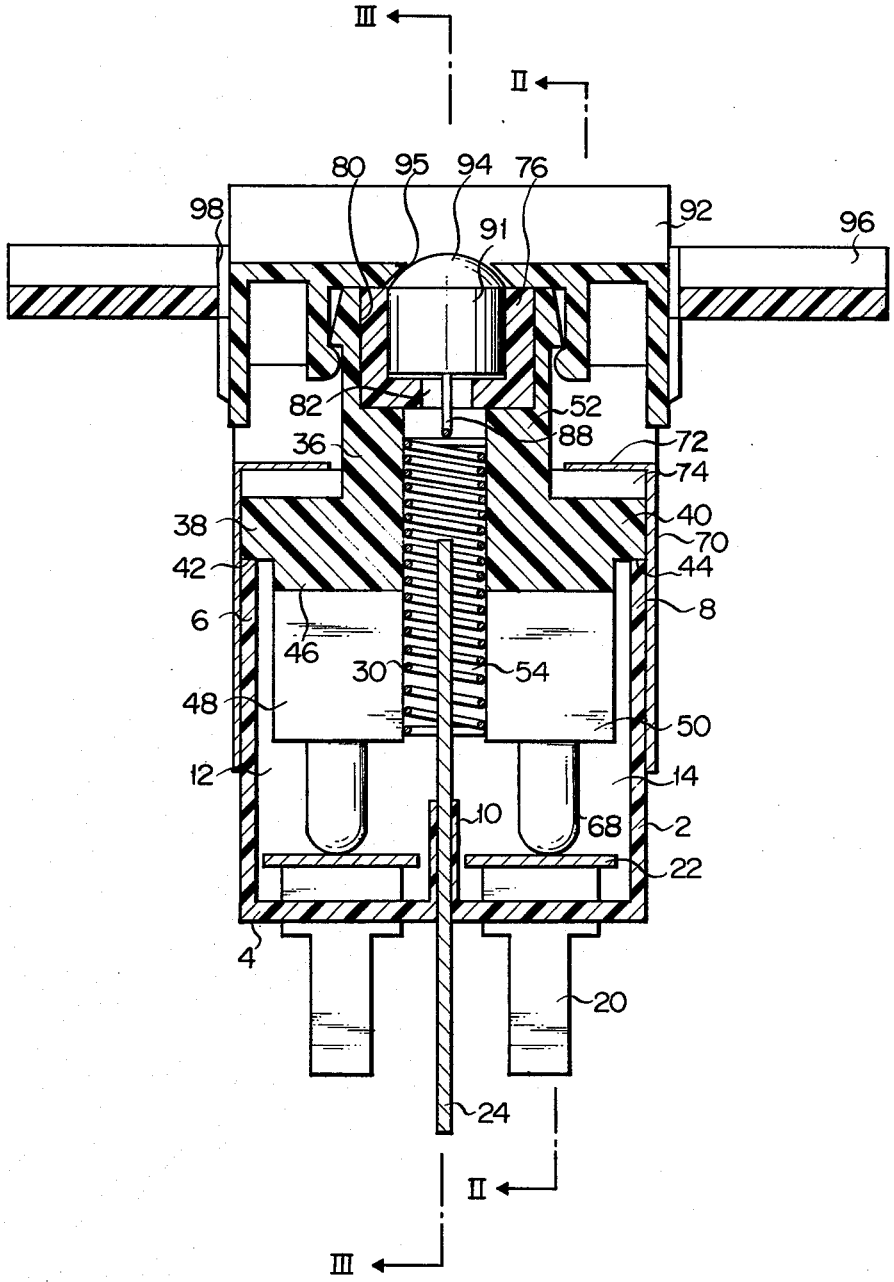
FIG. 1 is a profile of a seesaw switch with a light emitting diode element according to an embodiment of this invention.
Figure 2:
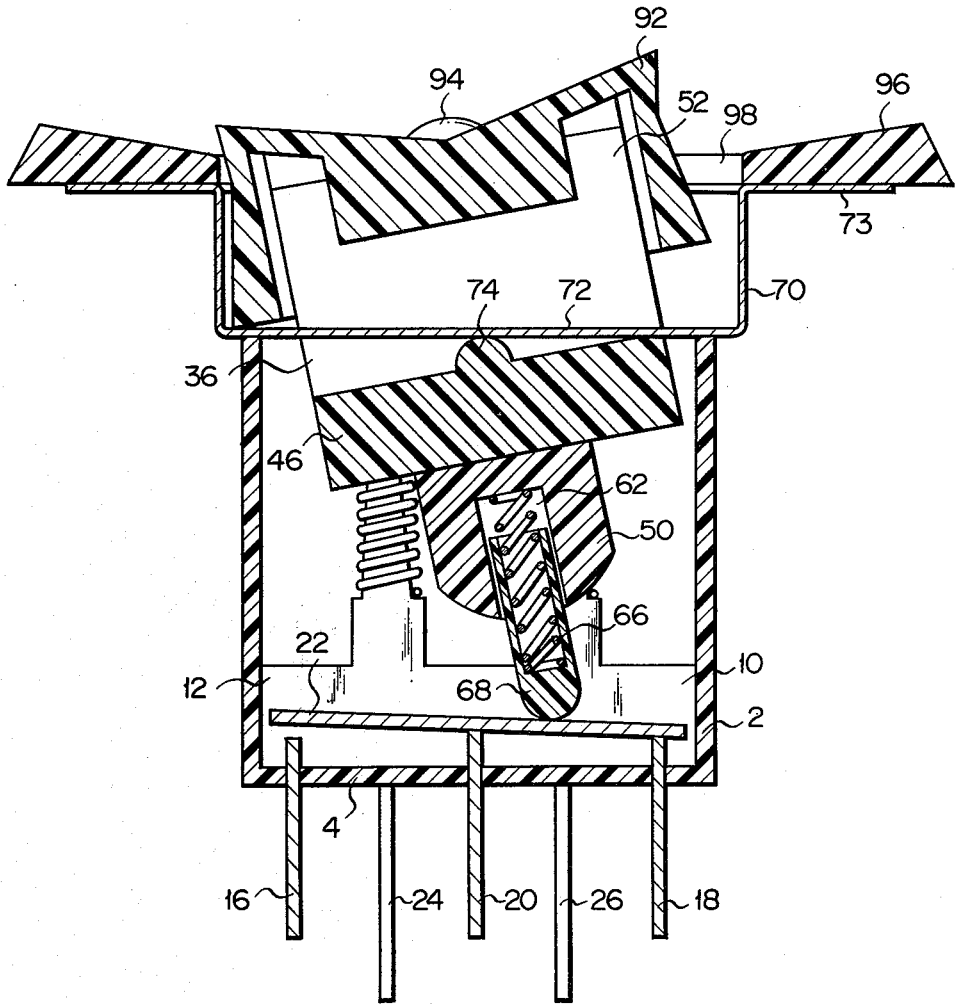
FIG. 2 is a sectional view as taken along line II—II of FIG. 1.
Figure 3:
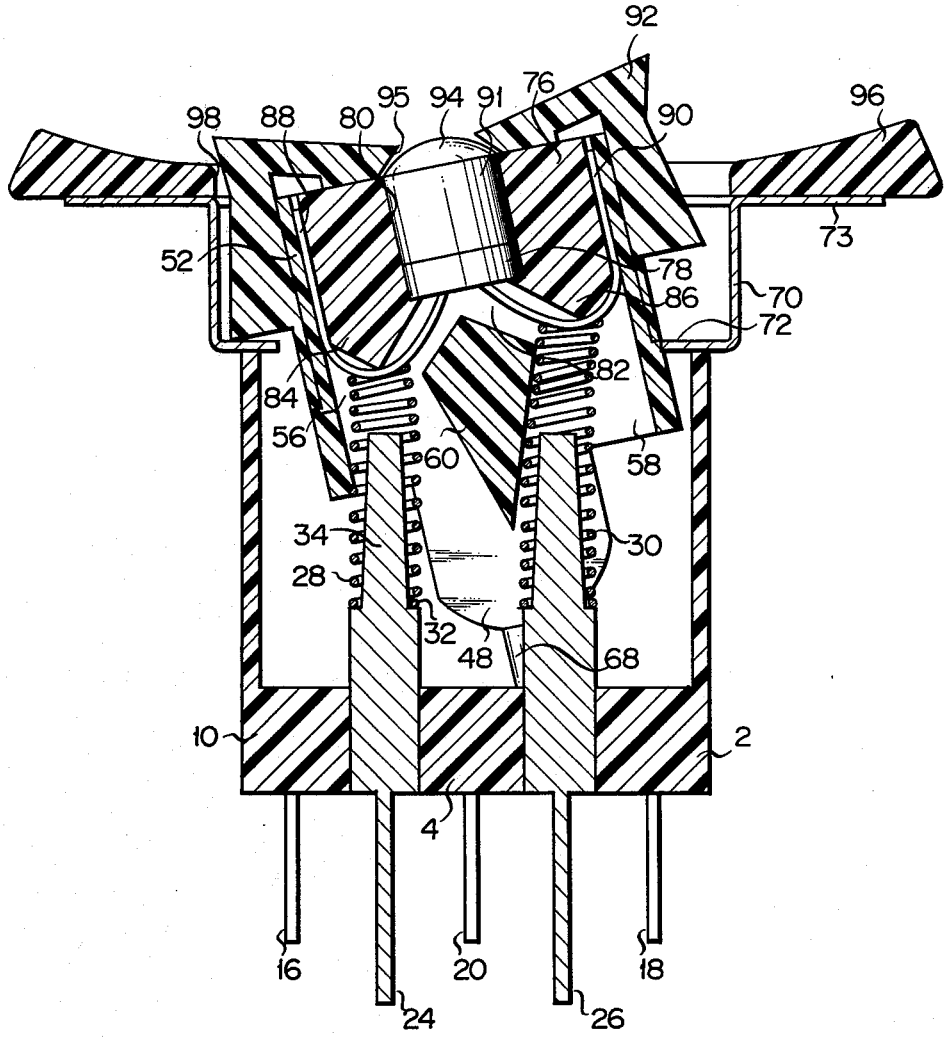
FIG. 3 is a sectional view as taken along line III—III of FIG. 1.

The seesaw switch according to an embodiment of the invention as shown in FIG. 1 includes a boxlike case 2 of electrically insulating plastic material. The lower space inside the case 2 is divided into two parts, first and second chambers 12 and 14, by means of a partition wall 10 protruding from a bottom portion 4 of the case 2 in parallel with side portions 6 and 8 of the case 2. As shown in FIG. 2, one-end portions of platelike first and second switching terminals 16 and 18 and a common terminal 20 fixed to the bottom portion 4 of the case 2 project into each of the first and second chambers 4. These three terminals 16, 18 and 20 are arranged in parallel with one another at regular intervals, the other ends thereof extending out of the case 2. The one-end portions of the switching terminals 16 and 18 are at an equal height above the bottom portion 4, whereas the one-end portion of the common terminal 20 disposed between the terminals 16 and 18 extends higher than those of the terminals 16 and 18. An electrically conductive movable contact 22 is disposed on the one-end portions of these terminals 16, 18 and 20 so as to move in a seesaw fashion. Embedded in the partition wall 10, as shown in FIGS. 1 and 3, are a pair of platelike terminals 24 and 26 for supplying power to a light emitting diode (hereinafter referred to simply as LED) element 91 one end of each of the terminals 24 and 26 extending to the opening portion of the case and the other end protruding outside the case 4, like those of the foregoing three terminals. Each of the power supply terminals 24 and 26 is provided with a stepped portion 32 on which each of electrically conductive springs 28 and 30 presses. The portions 34 above the stepped portions 32 of the terminals 24 and 26 are tapered, and inserted in the spring 28 and 30 respectively, each having a width smaller than the inside diameter of the springs 28 and 30.

A rockable member 36 is held inside the case 2. The rockable member 36 has a pair of shaft portions 38 and 40 at its center of rocking, which are received, respectively, by bearing recesses 42 and 44 formed at the upper parts of the side portions 6 and 8 of the case 2, respectively. A base section 46 of the rockable member 36 on which the shaft portion 38 and 40 rest has a width substantially equal to or smaller than the inside width of the case 2, as shown in FIG. 1, and a depth smaller than the inside depth of the case 2, as shown in FIGS. 2 and 3. A pair of leg sections 48 and 50 extend from the base section 46 toward the bottom portion 4 of the case 2. Outside the opening of the case 2 is a holder receptacle 52 formed integrally on the base section 46. Between the leg sections 48 and 50 is enough space 54 to accommodate the springs 28 and 30. Bored in the base section 46 are holes 56 and 58 communicating with the space 54 and the holder receptacle 52, and allowing the respective springs 28 and 30 to be inserted therein. Between the holes 56 and 58 is a spacer 60 so disposed that the two springs 28 and 30 may not come into contact with each other. Attached integrally to the base section 46, the spacer 60 has a substantially inverted-triangular section with a sharp bottom, as shown in FIG. 3. The springs 28 and 30 are inserted in the holes 56 and 58, respectively, the upper end portions of the springs being bent as the rockable member 36 tilts, as shown in FIG. 3. Integrally molded out of plastic or some other insulating material, the rockable member 36 is bisymmetrical as shown in FIGS. 1 and 3.

Each of the leg sections 48 and 50 has an opening 62 in which a spring 66 and a spring-biased sliding rod 68 are inserted, the sliding rod 68 being pressed against the movable contact 22. At the opening portion of the case 2 is a frame 70 fixed to the case 2. On top of the shaft portions 38 and 40 is a projection 74 hitting against a flange portion 72 of the frame 70. Since the rockable member 36 is spring-biased by the coil spring 66 to be forced up, the projection 74 is continually pressed against the flange portion 72 of the frame 70.

Figure 4:
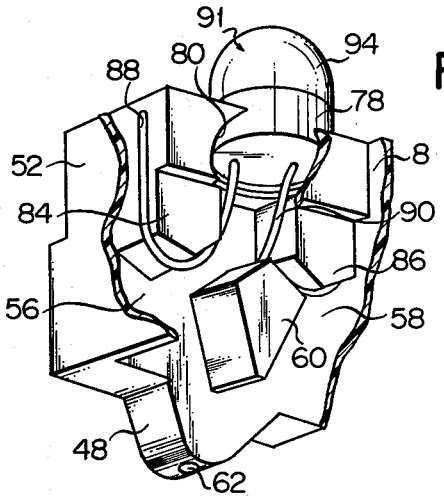
FIG. 4 is a perspective part-sectional view showing a holder for supporting the light emitting diode element used with the seesaw switch as shown in FIGS. 1 to 3 and a rockable member containing the holder.

The holder receptacle 52, as shown in FIG. 4, contains a holder 76 fitted with the LED element 91. Bored through the holder 76 are a receiving hole 80 to receive a base portion 78 of the LED element 91 and a lead wire hole 82 communicating with the receiving hole 80. At the lower portion of the holder 76 there are formed a pair of sharp projections 84 and 86, while lead wire guide grooves are formed on the sides of the holder 76. A pair of lead wires 88 and 90 extend from the LED element 91 through the lead wire hole 82, are bent in opposite directions so as to separate from each other, are curved by the corresponding projections 84 and 86, and extend along the guide groove on each corresponding side of the holder 76. The lead wires 88 and 90 extending along the guide grooves are held between each side of the holder 76 and the holder receptacle 52 and are fixed. The spring 28 fitted on the terminal 24 is disposed inside the hole 56, and is pressed against the lead wire 88 on the projection 84 by its biasing force. Likewise, the spring 30 fitted on the terminal 26 is disposed inside the hole 58, and is pressed against the lead wire 90 on the projection 86 by the biasing force.

As shown in FIGS. 1 to 3, the holder receptacle 52 is fitted in a seesaw button 92, and a light emitting portion 94 of the LED element 91 is exposed through a hole 95 substantially at the center of the seesaw button 92. The seesaw button 92 is of a corrugated shape with the central portion depressed for ease of manual switching, as shown in FIGS. 2 and 3. The frame 70 includes a panel mounting portion 73 which extends upward and is bent outward, as shown in FIGS. 2 and 3. A panel 96 is mounted on the panel mounting portion 73. Formed in the panel 96 is a substantially rectangular window 98, through which the seesaw switch 92 appears.

In the seesaw switch of the aforementioned construction, when the seesaw button 92 is tilted to one side, the rockable member 36 is rocked on the shaft portions 38 and 40 borne by the recesses 42 and 44, respectively. Since the lower end portion of the seesaw button 92 then hits against the flange portion 72 of the frame 70, as shown in FIGS. 2 and 3, the rockable member 36 is turned through a fixed angle. Accompanying the rotation of the rockable member 36, the leg sections 48 and 50 are turned to be tilted at a fixed angle, so that the sliding rods 68 held in the leg sections 48 and 50 move on the movable contact 22, while spring-biased, thereby bringing the movable contact 22 in seesaw motion centering around the common terminal 20. When the movable contact 22 is put in the seesaw motion, the switching terminals 16 and 18 to be connected with the common terminal 20 are switched from one to the other. In such switching operation, the springs 28 and 30 are distorted as shown in FIG. 3 accompanying the turning motion of the rockable member 36. Since the springs 28 and 30, being formed of conductive material, are brought in continual contact with their corresponding lead wires 88 and 90 and the respective stepped portions 32 of their corresponding terminals 24 and 26 by their own biasing force, the lead wires 88 and 90 are securely electrically connected with the terminals 24 and 26, respectively. Above all, the top ends of the springs 28 and 30, being distorted accompanying the rotation of the rockable member 36, are pressed against the lead wires 88 and 90 on the projections 84 and 86, so that the springs may be sure to be electrically connected with the lead wires without fail. Moreover, the lead wires 88 and 90 are pressed against the springs 28 and 30 by the spring-biasing force, so that the holder 76 is also subjected to the spring-biasing force and forced up. Accordingly, the light emitting portion 94 of the LED element 91 attached to the holder 76 is securely pushed into the hole 95 of the seesaw button 92 to be exposed from the surface of the seesaw button 92. If the light emitting portion 94 is forced down by a finger, it will always be held in place because the holder 76 itself is pushed up by the spring-biasing force. Recesses instead of the projections 84 and 86 may be formed on the holder 76 to receive the top ends of the springs 28 and 30. Also, there may be disposed on the holder 76 metal projections instead of the projections 84 and 86.

Figure 5:
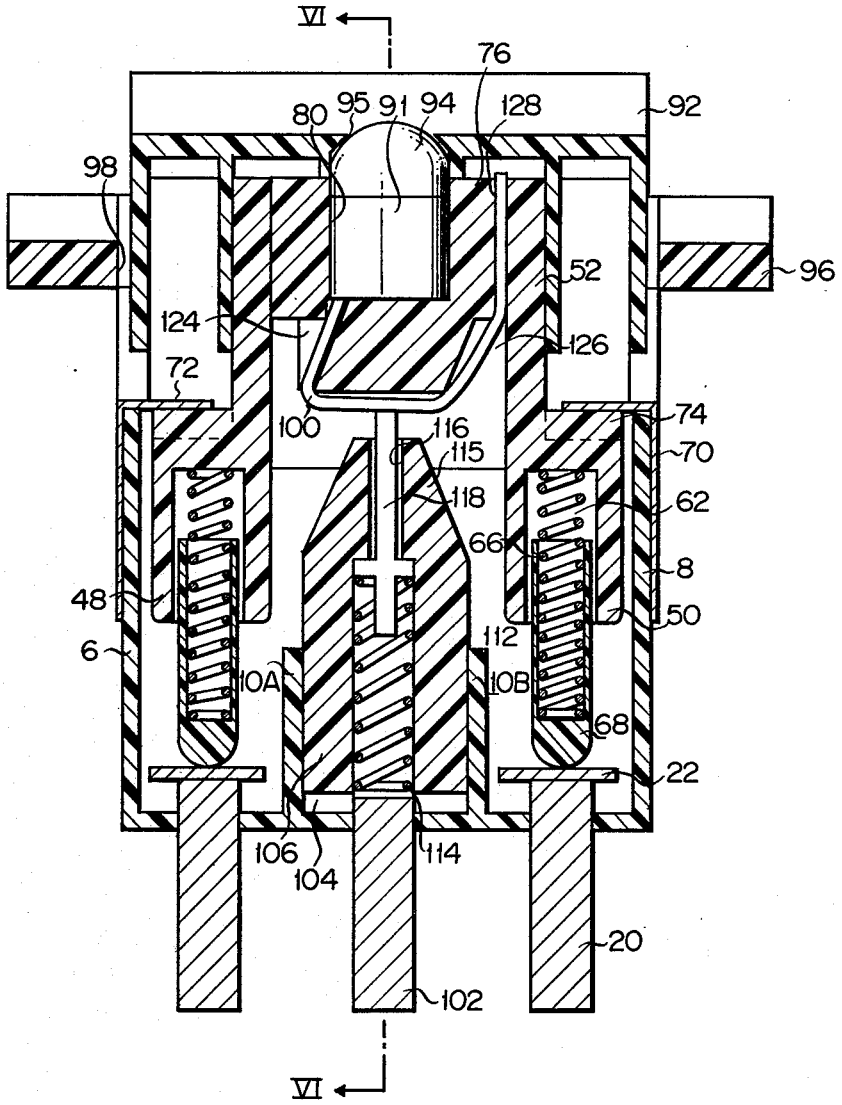
FIG. 5 is a profile of a seesaw switch with a light emitting diode element emitting two color lights according to another embodiment of the invention.
Figure 6:
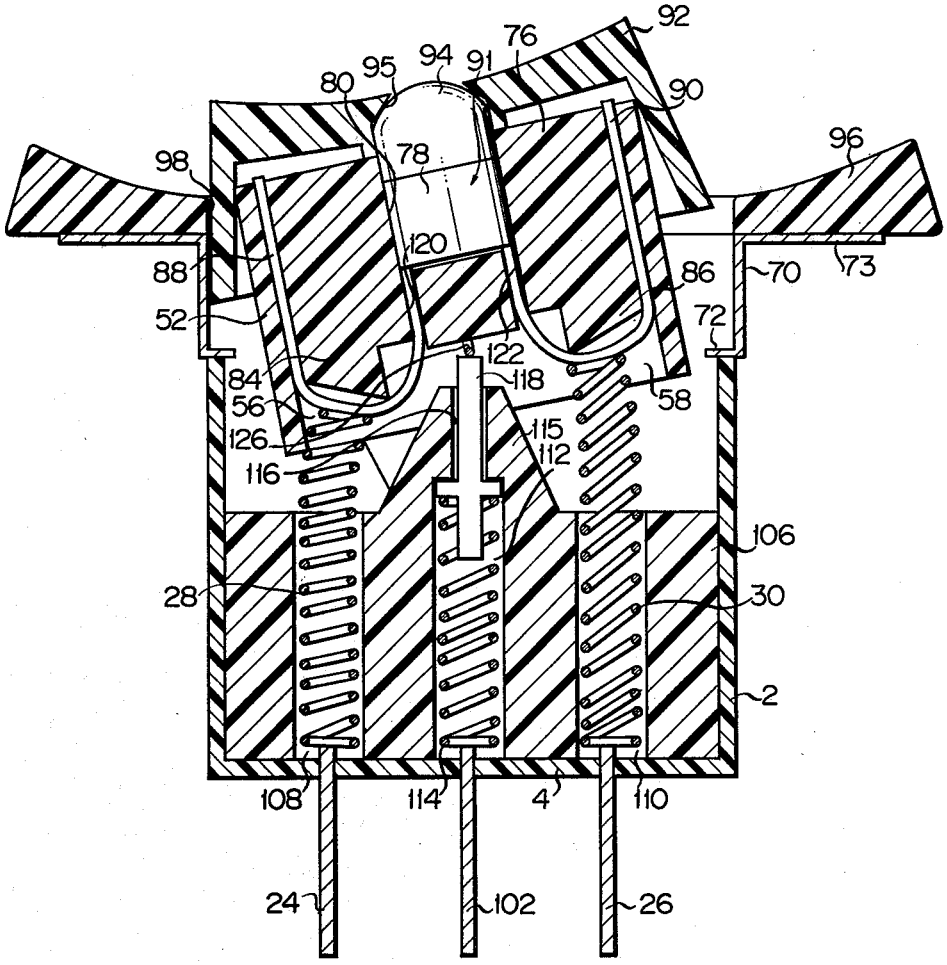
FIG. 6 is a sectional view as taken along line VI—VI of FIG. 5.

Referring now to FIGS. 5 and 6, there will be described another embodiment of the seesaw switch of this invention. In FIGS. 5 and 6, the same parts as shown in FIGS. 1 to 4 are designated by like reference numerals, and are excluded from the following description. The seesaw switch as shown in FIGS. 5 and 6 has the LED element 91, called dichromatic light emitting diode, which is provided with three lead wires 88, 90 and 100. Accordingly, three power supply terminals 24, 26 and 102 are fixed to the bottom portion 4 of the case 2. The lower space inside the case 2 is divided into three parts, first, second and third chambers 12, 14 and 104, by means of partition walls 10A and 10B protruding from the bottom portion 4 of the case 2 in parallel with the side portions 6 and 8 of the case 2. One-end portions of the power supply terminals 24, 26 and 102 project into the third chamber 104 of the case 2. The third chamber 104 contains a spring holder 106, through which first, second and third holes 108, 110 and 112 corresponding to the respective positions of the three terminals 24, 26 and 102 are bored. As shown in FIG. 6, the holes 108, 110 and 112 contain first, second and third coil springs 28, 30 and 114 formed of electrically conductive metal, respectively. Disposed at the center of the spring holder 106 is a conical convex 115 as shown in FIG. 6. Along the center of the conical convex 115, there if formed a fourth hole 116 communicating with the third hole 112, with an inside diameter smaller than that of the third hole 112. Naturally, the spring holder 106 is formed of plastic or some other insulating material. A shaft portion is inserted in the third and fourth holes 112 and 116, and a contact rod 118 with its flange contained in the third hole 116 is pushed up by the third spring 114. The contact rod, like the springs, is formed of electrically conductive metal.

The rockable member 36 is substantially the same as the one used with the embodiment as shown in FIGS. 1 to 4, except for the existence of the spacer 60. The holder 76 is fitted in the holder receptacle 52 of the rockable member 36, as shown in FIGS. 5 and 6. Bored through the holder 76 are three lead wire holes 120, 122 and 124 communicating with the receiving hole 80, and three lead wires 88, 90 and 126 extending from the base portion 78 of the LED element 91 received by the receiving hole 80 are inserted in their corresponding holes 120, 122 and 124. The lead wire 126 is a common lead wire for the dichromatic light emitting diode element 91. The common lead wire 126 is bent on the bottom face of the holder 76, and led to a guide groove 128 on the side of the holder 76 so as not to come in contact with the other lead wires. The common lead wire 126 on the bottom face of the holder 76 is so disposed as to cross the center of the holder bottom, extending in a direction perpendicular to the direction in which the other lead wires 88 and 90 extend. The lead wire 126 is in contact with the top face of the spring-biased contact rod 118, as shown in FIG. 6. The contact position between both of these members is brought in alignment with the center of rocking of the rockable member 36, and the common lead wire 126 is securely electrically connected with the contact rod 118 because the contact rod 118 is spring-biased. The lead wires 88 and 90, which are arranged in the same manner as the case of the embodiment of FIGS. 1 to 4, are surely electrically connected with the springs 28 and 30, respectively.

According to the seesaw switch of the aforementioned embodiment, switching of the seesaw button 92 may ensure the switching operation and the power supply to the LED element 91.

Figure 9:
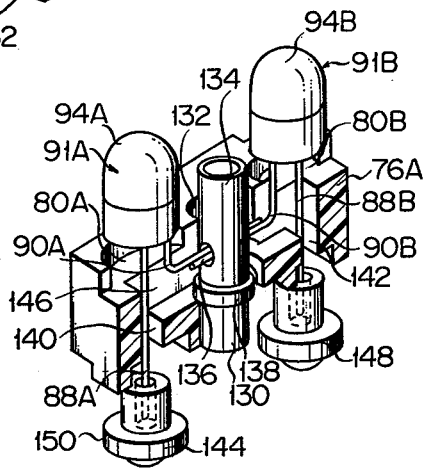
FIG. 9 is a perspective part sectional view showing a holder for supporting the light emitting diode elements used with the seesaw switch as shown in FIGS. 7 and 8.
Figure 7:
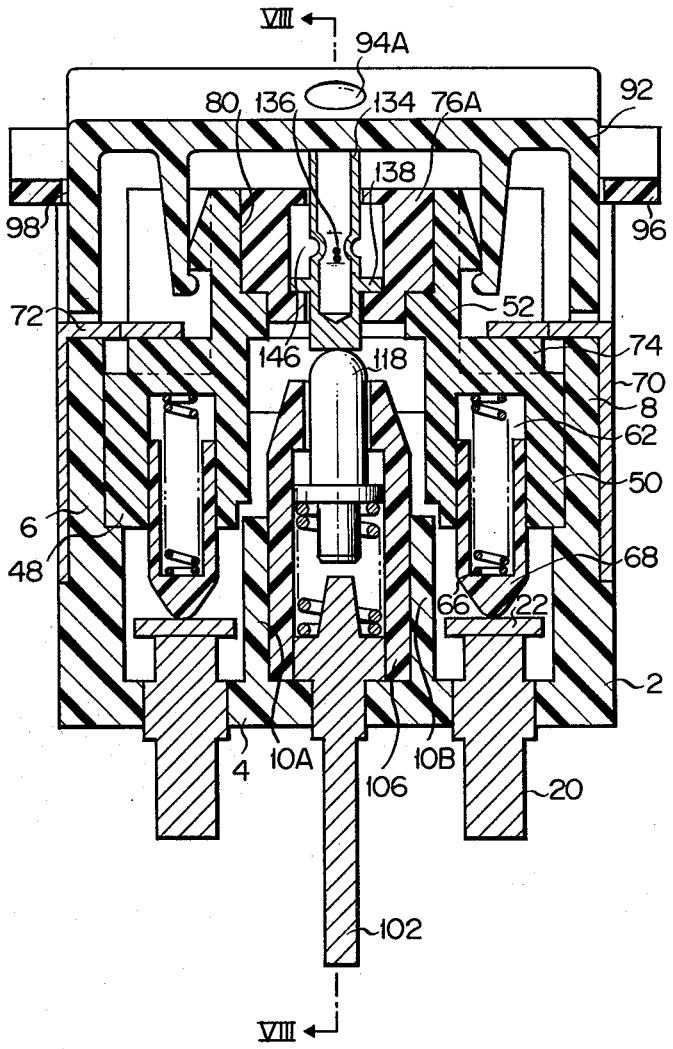
FIG. 7 is a profile of a seesaw switch with two light emitting diode elements according to still another embodiment of the invention.
Figure 8:
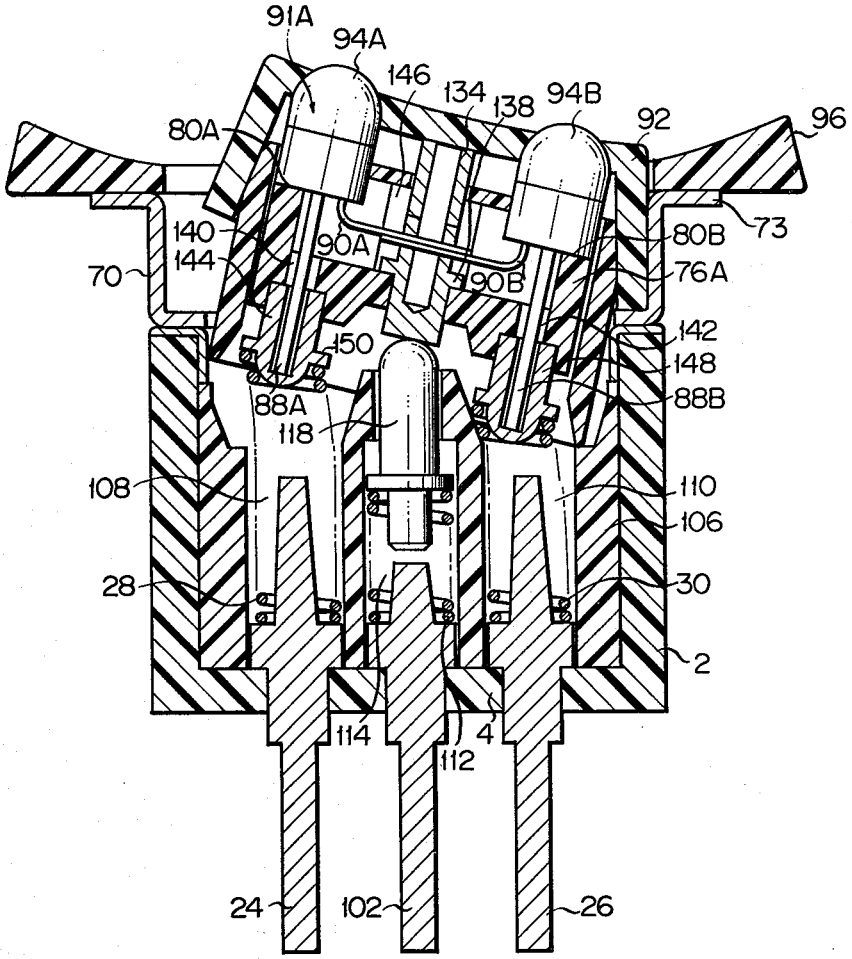
FIG. 8 is a sectional view as taken along line VIII—VIII of FIG. 7.

Referring now to FIGS. 7 to 9, there will be described still another embodiment of the seesaw switch of this invention.

The seesaw switch as shown in FIGS. 7 and 8, including two LED elements 91A and 91B, has the same fundamental construction as that of the seesaw switch as shown in FIGS. 5 and 6. In FIGS. 7 and 8, the same parts as shown in FIGS. 5 and 6 are referred to by like reference numerals, and are excluded from the following description. In FIG. 9 there is shown a holder 76A for holding the two LED elements 91A and 91B. The holder 76A, having two receiving holes 80A and 80B formed separated from each other, receives the respective base portions 78 of the LED elements 91A and 91B corresponding to the holes 80A and 80B respectively. Also, bored through the holder 76A is a hole 132 for sustaining a splicer 130 for connecting in common the lead wires 90A and 90B extending, respectively, from the LED elements 91A and 91B. The splicer 130 includes a cylindrical main body 134 formed of electrically conductive metal, a lead wire hole 136 bored through the side of the body 134, and a flange 138 for mooring the splicer 130 to the holder 76A. Bored through the holder 76A are lead wire holes 140 and 142 communicating with the receiving holes 80A and 80B, the holder 76A being hollow. The lead wire 88A of the LED element 91A extends through the lead wire hole 140 to be connected with a metallic contact member 144 outside the holder 76A, while the lead wire 90A extends through a hollow portion 146 inside the holder 76A to be inserted in the hole 136 of the splicer 130. Similarly, the lead wire 88B of the LED element 91B extends through the hole 142 to be connected with a contact member 148, while the lead wire 90B is inserted in the hole 136 of the splicer 130. Since the periphery of the hole 136 of the splicer 130 is fixed, the lead wires 90A and 90B are securely fixed to the splicer 130. Likewise, the lead wires 88A and 88B inserted in the respective insertion holes of the contact member 144 and 148 are securely fixed to th contact members 144 and 148, because the peripheries of such insertion holes are caulked. The holder 76A, as illustrated, is attached to the holder receptacle 52 of the rockable member 36, while the holder receptacle 52 is covered with the seesaw button 92. As is clear from the drawings, the seesaw button 92 is provided with holes 95 through which light emitting portions 94A and 94B of the two LED elements 91A and 91B are exposed correspondingly to the positions of the LED elements 91A and 91B. The bottom face of the seesaw button 92 is in contact with the top of the splicer 130, and the flange 138 of the splicer 130 is pressed against the bottom of the hollow portion 146, so that the splicer 130 may securely be held between the holder 76A and the seesaw button 92. Like the case of the aforesaid embodiment, the splicer 130 is in contact with the spring-biased contact rod 118. The contact members 144 and 148 are in contact with the springs 28 and 30, respectively. Additionally, the contact members 144 and 148 each include a flange 150 so as to be in continual contact with their corresponding springs 28 and 30.

Figure 10:
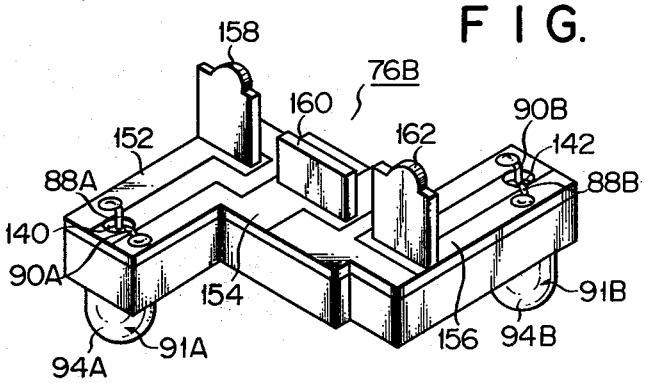
FIG. 10 is a perspective view showing another example of the holder for supporting the two light emitting diode elements shown in FIG. 7.

FIG. 10 illustrates a modification of a holder according to another embodiment. FIG. 10 is a perspective back view of the holder 76B, in which the top of the holder 76B is not shown. Like the holder 76A, the holder 76B has receiving holes to receive the base portions of the LED elements. Circuit patterns 152, 154 and 156 are formed on the back side of the holder 76B with three contact plates 158, 160 and 162 protruding therefrom. Naturally, the main body of the holder 76B is formed of insulating plastic or the like, while the contact plates, securely fixed to the holder 76B, are formed of conductive metal. The three contact plates 158, 160 and 162 are arranged substantially in a line, and electrically connected with their corresponding circuit patterns 152, 154 and 156. The circuit pattern 152 connected with the contact plate 158 extends to the vicinity of the lead wire hole 140, and is connected to the lead wire 88A extending from inside the hole 140. Likewise, the circuit pattern 156 connected with the contact plate 162 extends to the vicinity of the hole 142, and is connected to the lead wire 88B. The circuit pattern 154 connected with the common contact plate 160 extends to the vicinity of both those holes 140 and 142, and is connected to each of the lead wires 90A and 90B. Since the holder 76B differs from the abovementioned alternative example of the holder in shape, the holder receptacle to sustain the holder 76B has a container portion corresponding to the shape of the holder 76B. Further, the three contact plates 158, 160 and 162 are connected to their corresponding terminals 24, 26 and 102 through the coil springs 28, 30 and 114, as already described.

Thus, according to this invention, the lead wires of the LED element or elements may be continually electrically connected with their corresponding terminals even if the seesaw button is switched. Moreover, the construction of the seesaw switch is convenient for manufacture and assembly although the LED element is attached to the seesaw button.

What is claimed is:

1. A seesaw switch, comprising:

(a) a light emitting diode element including at least two lead wires for power supply, a base to which said lead wires are fixed and from which said lead wires extend, and a light emitting portion disposed on said base;

(b) a holder for holding said base of the light emitting diode element, said lead wires extending from said base along the outer surface of said holder and being separated from one another;

(c) a rockable member having a holder receiving portion to receive said holder and a hole through which said lead wires arranged along the outer surface of said holder are exposed;

(d) a case for rockably supporting said rockable member, said case having an opening and said holder receiving portion of said rockable member being disposed outside the opening of said case;

(e) a seesaw button on the holder receiving portion of said rockable member and having a hole in which the light emitting portion of said light emitting diode element is received, said light emitting portion being exposed to the outside of said switch through said seesaw button hole;

(f) a common terminal and two switching terminals of electrically conductive metal fixed to said case and extending from the inside to the outside of said case;

(g) a movable contact of electrically conductive metal at the ends of said terminals inside said case, said movable contact always being in contact with said common terminal, and in selective contact with either of said two switching terminals;

(h) a spring-biased rod having one end supported by said rockable member and the other end spring-biased to bear against said movable contact, said other end sliding on said movable contact depending upon the turning motion of said rockable member, whereby said movable contact is switched from contact with one of said switching terminals to contact with the other of said switching terminals;

(i) at least two power supply terminals of electrically conductive metal for supplying electric power to said light emitting diode element, said power supply terminals being fixed to said case and extending from the inside to the outside of said case;

(j) at least two springs of electrically conductive metal separately disposed in the hole of said rockable member, each of said springs being pressed against and interposed between a respective power supply terminal and an associated lead wire arranged along the outer surface of said holder, by means of the biasing force of said springs, said springs expanding and contracting with the rocking of said rockable member; and (k) spring support means for continually keeping in place said springs when they are distorted by said expansion and contraction.

2. A seesaw switch according to claim 1, wherein said holder has a pair of separated members to be located inside the hole of said rockable member, and said lead wires extending from the base of said light emitting diode element are arranged on respective ones of said projections and pressed against said springs on said separated members, respectively.

3. A seesaw switch according to claim 1, wherein said spring support means comprise narrowed portions of said power supply terminals inserted in said springs, each of said power supply terminals having a stepped portion against which the corresponding one of said springs bears and a tip end extending into the hole of said rockable member.

4. A seesaw switch according to claim 1, wherein said rockable member includes a spacer disposed inside the hole thereof to separate the two springs arranged inside said hole from each other.

5. A seesaw switch, comprising:

(a) a dichromatic light emitting diode element including first, second and third lead wires for power supply, a base to which said lead wires are fixed and from which said lead wires extend, and a light emitting portion disposed on said base;

(b) a holder for holding said base of the light emitting diode element, said lead wires extending from said base along the outer surface of said holder and being separated from one another;

(c) a rockable member having a hole through which said lead wires arranged along the outer surface of said holder are exposed and a holder receiving portion to receive said holder and to locate said third lead wire substantially on the center of rocking;

(d) a case for rockably supporting said rockable member, said case having an opening and said holder receiving portion of said rockable member being disposed outside the opening of said case;

(e) a seesaw button on the holder receiving portion of said rockable member and having a hole in which the light emitting portion of said light emitting diode element is received, said light emitting portion being exposed to the outside of said switch through said seesaw button hole;

(f) a common terminal and two switching terminals of electrically conductive metal fixed to said case and extending from the inside to the outside of said case;

(g) a movable contact of electrically conductive metal at the ends of said terminals inside said case, said movable contact always being in contact with said common terminal, and in selective contact with either of said two switching terminals;

(h) a spring-biased rod having one end supported by said rockable member and the other end spring-biased to bear against said movable contact, said other end sliding on said movable contact depending upon the turning motion of said rockable member, whereby said movable contact is switched from contact with one of said switching terminals to the other;

(i) first, second and third power supply terminals of electrically conductive metal for supplying electric power to said dichromatic light emitting diode element, said power supply terminals being fixed to said case and extending from the inside to the outside of said case;

(j) three spring support holes supported by said case and into which said three power supply terminals project respectively;

(k) a contact rod of electrically conductive metal having a tip end located inside the hole of said rockable member and pressed against said third lead wire on the outer surface of said holder; and (l) first, second and third springs inserted in said spring support holes, respectively, with one end of each of said first, second and third springs pressing on a respective one of said power supply terminals, the other ends of said first and second springs being located inside said rockable member and spring-biased to bear against said first and second lead wires on the outer surface of said holder, the other end of said third spring being spring-biased to bear against said contact rod.

6. A seesaw switch according to claim 5, wherein said holder has a pair of separated projections to be located inside the hole of said rockable member, and said first and second lead wires extending from said dichromatic light emitting diode element are arranged on said projections respectively, and are pressed against said first and second springs on said projections respectively.

7. A seesaw switch according to claim 5, wherein each of said first, second and third power supply terminals includes a narrowed portion inserted in the corresponding spring and a stepped portion against which said corresponding spring bears.

8. A seesaw switch, comprising:

(a) first and second light emitting diode elements, each light emitting diode element including two lead wires for power supply, a base to which said lead wires are fixed and from which said lead wires extend, and a light emitting portion disposed on said base;

(b) a holder for holding the bases of both of said light emitting diode elements, one of said lead wires extending from the respective bases of said two light emitting diode elements along the outer surface of said holder and being separated from each other, and the other of said lead wires being arranged inside said holder;

(c) a splicer supported by said holder for connecting said other of said lead wires in common;

(d) a rockable member having a hole through which said one of said lead wires are exposed and a holder receiving portion to receive said holder so as to locate one end of said splicer substantially on the center of rocking;

(e) a case for rockably supporting said rockable member, said case having an opening and said holder receiving portion of said rockable member being disposed outside the opening of said case;

(f) a seesae button on the holder receiving portion of said rockable member and having holes in which the respective light emitting portions of said light emitting diode elements are received correspondingly, each of said light emitting portions being exposed to the outside of said switch through the corresponding one of said corresponding seesaw button holes;

(g) a common terminal and two switching terminals of electrically conductive metal fixed to said case and extending from the inside to the outside of said case;

(h) a movable contact of electrically conductive metal at the ends of said terminals inside said case, said movable contact always being in contact with said common terminal, and in selective contact with either of said two switching terminals;

(i) a spring-biased rod having one end supported by said rockable member and the other end spring-biased to bear against said movable contact, said other end sliding on said movable contact depending upon the turning motion of said rockable member, whereby said movable contact is switched from contact with one of said switching terminals to the other;

(j) first, second and third power supply terminals of electrically conductive metal for supplying electric power to said light emitting diode elements, said power supply terminals being fixed to said case and extending from the inside to the outside of said case;

(k) three spring support holes supported by said case and into which said three power supply terminals project respectively;

(l) a contact rod of electrically conductive metal having a tip end located inside the hole of said rockable member and pressed against one end of said splicer; and (m) first, second and third springs inserted respectively in said spring support holes with one end of each of the first, second and third springs pressing on a respective one of said power supply terminals, the other ends of said first and second springs being located inside said rockable member and spring-biased to bear against the two lead wires extending to the outsi-e of said holder, the other end of said third spring being spring-biased to bear against said contact rod.

9. A seesaw switch according to claim 8, wherein said holder has a pair of separated projections to be located inside the hole of said rockable member, and said one of said lead wires extending from said two light emitting diode elements are arranged on said projections respectively and pressed against said first and second springs on said projections, respectively.

10. A seesaw switch according to claim 8 which further includes two splicers, each disposed on a respective one of said one lead wires extending from said bases of said two light emitting diode elements, said lead wires being connected to said springs through said splicers, respectively.

11. A seesaw switch according to claim 8 wherein said holder includes circuit patterns connected to said one and the other lead wires, and three contact plates fitted to said holder and projecting from the bottom thereof, said three contact plates being connected to said circuit patterns and being respectively contacted with said first, second and third springs.

* * * * *